US005554496A

United States Patent [19]

Shiratsuchi et al.

[11] Patent Number: 5,554,496

[45] Date of Patent: Sep. 10, 1996

[54] SILVER HALIDE PHOTOGRAPHIC MATERIAL COMPRISING EMULSION LAYER AND BACKING LAYER PROVIDED ON SUPPORT

[75] Inventors: Kentaro Shiratsuchi; Satoru Toda; Tsukasa Yamada, all of Kanagawa, Japan

[73] Assignee: Fuji Photo Film Co., Ltd., Kanagawa, Japan

[21] Appl. No.: 397,494

[22] Filed: Mar. 2, 1995

[30] Foreign Application Priority Data

Mar. 2, 1994 [JP] Japan ..... 6-032111

[51] Int. Cl.[6] ..... G03C 1/81; G03C 1/76

[52] U.S. Cl. ..... 430/536; 430/537; 430/627

[58] Field of Search ..... 430/523, 536, 430/537, 531, 627

[56] References Cited

U.S. PATENT DOCUMENTS

| | | | |
|---|---|---|---|
| 3,920,456 | 11/1975 | Nittel et al. | 430/523 |
| 4,196,001 | 4/1980 | Joseph et al. | 430/502 |
| 4,209,584 | 6/1980 | Joseph | 430/527 |
| 4,312,940 | 1/1982 | Nakamura et al. | 430/537 |
| 4,507,385 | 3/1985 | Steklenski et al. | 430/536 |
| 5,015,562 | 5/1991 | Toya et al. | 430/523 |

*Primary Examiner*—Lee C. Wright

*Attorney, Agent, or Firm*—Sughrue, Mion, Zinn, Macpeak & Seas

[57] ABSTRACT

A silver halide photographic material comprises a silver halide emulsion layer and an anticurl backing layer provided on a support. A surface backing layer is further provided on the anticurl backing layer. The surface backing layer comprises a hydrophobic polymer. The hydrophobic polymer has a repeating unit represented by the formula (I):

(I)

in which $R^1$ is hydrogen or an alkyl group; X is —COO—, —$CONR^3$— or phenylene; $R^3$ is hydrogen or an alkyl group; $R^2$ is a single bond or an alkylene group; L is a single bond or a divalent linking group, —OCO—, —NHCOO—, —$OCOCH_2$—, —NHCONH—, —NHCO—, —NH— or —O—; and Cy is an alicyclic group consisting of a monocyclic ring and having three to sixteen carbon atoms.

20 Claims, 1 Drawing Sheet

SILVER HALIDE PHOTOGRAPHIC MATERIAL COMPRISING EMULSION LAYER AND BACKING LAYER PROVIDED ON SUPPORT

FIELD OF THE INVENTION

The present invention relates to a silver halide photographic material. The invention more particularly relates to a silver halide photographic material comprising a silver halide emulsion layer and an anticurl backing layer provided on a support.

BACKGROUND OF THE INVENTION

A silver halide photographic material usually comprises a silver halide emulsion layer and an anticurl backing layer provided on a support.

The silver halide emulsion layer comprises silver halide grains dispersed in a hydrophilic binder such as gelatin. The emulsion layer absorbs the moisture because the hydrophilic binder is hygroscopic. Therefore, the photographic material tends to be curled according to the change of the humidity. The curled photographic material causes a jam while conveying the material in an automatic processing machine.

An anticurl (non-curling) backing layer is usually provided on the reverse side of the support to prevent the photographic material from curling. The anticurl backing layer contains a hydrophilic binder. The hygroscopic property of the anticurl backing layer is analogous to that of the emulsion layers. The curling force caused by the emulsion layer is balanced with the reverse curling force caused by the anticurl backing layer.

By the way, a recent silver halide photography requires rapid processes, namely a rapid development process, a rapid fixing process, a rapid washing process and a rapid drying process. The requirement of speedup is severe particularly in printing technical fields. The rapid process is also required to reduce the amounts of the waste processing solutions. Therefore, the silver halide photographic material has recently been improved to shorten the processing time.

The above-mentioned anticurl backing layer causes problems in the rapid processes of the photographic material. For example, the hydrophilic binder of the anticurl backing layer absorbs water contained in the processing solutions. A relatively long time is required to dry the layer absorbing water. Further, the amount of a replenisher should be increased to compensate the absorbed water.

Japanese Patent Provisional Publication Nos. 5(1993)-127282 (corresponding to U.S. Pat. No. 5,219,718 and European Patent Publication No. 514903A1) and 5(1993)-127306 propose a silver halide photographic material having a surface backing layer provided on the anticurl backing layer to solve the above-mentioned problems caused by the anticurl backing layer. The surface backing layer contains a hydrophobic polymer, which has a function of shielding the anticurl backing layer from the processing solutions.

SUMMARY OF THE INVENTION

The applicants note that the shielding function of the surface backing layer disclosed in Japanese Patent Provisional Publication Nos. 5(1993)-127282 and 5(1993)-127306 is still insufficient. The hydrophobic polymers should be further improved to solve the problems caused by the anticurl backing layer. Further, some hydrophobic polymers disclosed in the Publications cause a crack in the surface backing layer or make the layer adhesive.

An object of the present invention is to provide a silver halide photographic material having a surface backing layer which sufficiently shields an anticurl backing layer from processing solutions.

Another object of the invention is to provide a photographic material which can be quickly dried at a drying process.

A further object of the invention is to provide a photographic material which is scarcely curled, and does not cause a jam while conveying the material in an automatic processing machine.

A furthermore object of the invention is to provide a photographic material which merely requires small amounts of processing solutions and replenishers.

A still further object of the invention is to provide a photographic material having a surface backing layer which is free from the problems of the crack or the adhesion.

The present invention provides a silver halide photographic material comprising a silver halide emulsion layer and an anticurl backing layer provided on a support, wherein a surface backing layer is further provided on the anticurl backing layer, said surface backing layer comprising a hydrophobic polymer which has a repeating unit represented by the formula (I):

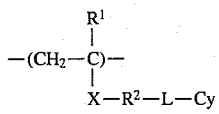

(I)

in which $R^1$ is hydrogen or an alkyl group having one to four carbon atoms; X is —COO—, —CONR$^3$— or phenylene; $R^3$ is hydrogen or an alkyl group having one to four carbon atoms; $R^2$ is a single bond or an alkylene group having one to three carbon atoms, which may be substituted with hydroxyl or a halogen atom; L is a single bond or a divalent linking group selected from the group consisting of —OCO—, —NHCOO—, —OCOCH$_2$—, —NHCONH—, —NHCO—, —NH— and —O—; and Cy is an alicyclic group consisting of a monocyclic ring and having three to sixteen carbon atoms, which may be substituted with an alkyl group, an alkenyl group or a halogen atom.

The applicants find that the above-mentioned hydrophobic polymer has an excellent function of shielding the anticurl backing layer from processing solutions. Accordingly, the anticurl backing layer scarcely absorbs water contained in the processing solution. Therefore, the photographic material of the present invention can be quickly dried at a drying process. Further, the photographic material merely requires small amounts of processing solutions and replenishers.

The surface backing layer of the present invention does not inhibit the function of the anticurl backing layer. Accordingly, the photographic material of the present invention is scarcely curled, and does not cause a jam while conveying the material in an automatic processing machine. Further, the surface backing layer of the present invention is free from the problems of the crack or the adhesion.

DETAILED DESCRIPTION OF THE INVENTION

Figure 1:
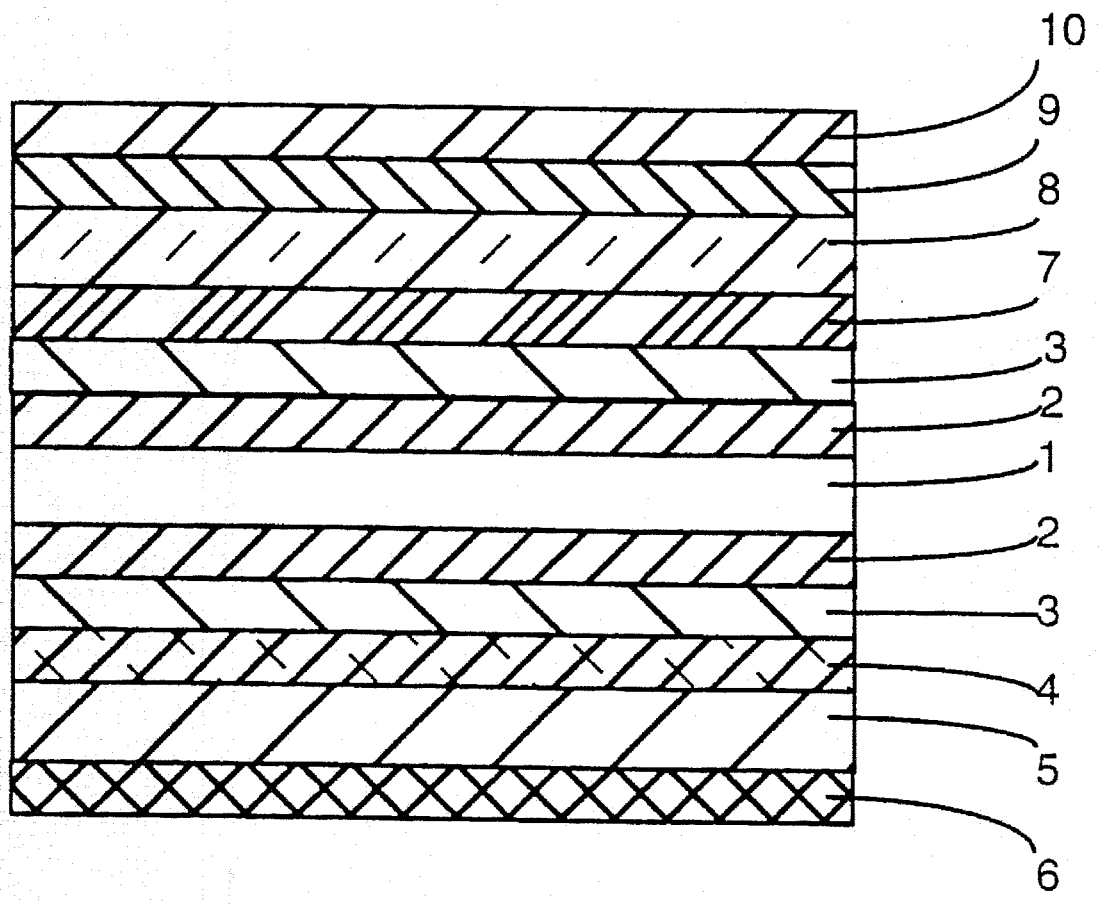
FIG. 1 is a sectional view schematically illustrating a preferred embodiment of the photographic material of the present invention.

The present invention is characterized by use of a specific hydrophobic polymer in a surface backing layer. The hydrophobic polymer has a repeating unit represented by the formula (I):

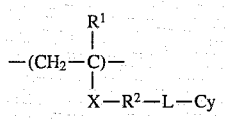

(I)

In the formula (I), $R^1$ is hydrogen or an alkyl group having one to four carbon atoms, and preferably is hydrogen or methyl.

X is —COO—, —CONR$^3$— or phenylene, and preferably is —COO— or —CONR$^3$—. $R^3$ is hydrogen or an alkyl group having one to four carbon atoms, and preferably is hydrogen.

$R^2$ is a single bond or an alkylene group having one to three carbon atoms (namely, methylene, ethylene or propylene). The single bond means that L is directly attached to X. The alkylene group may be substituted with hydroxyl or a halogen atom. The single bond, methylene, ethylene and 2-hydroxypropylene are preferred.

L is a single bond or a divalent linking group selected from the group consisting of —OCO—, —NHCOO—, —OCOCH$_2$—, —NHCONH—, —NHCO—, —NH— and —O—. The single bond means that Cy is directly attached to $R^2$ or X (in the case that $R^2$ is also a single bond). The single bond, —OCO— and —NHCOO— are preferred.

Cy is an alicyclic group consisting of a monocyclic ring. The monocyclic ring means that the ring does not contain a bridgehead carbon atom. Accordingly, a condensed ring and a spiro-ring are not included in the monocyclic ring. Cy preferably is a cycloalkyl group or a cycloalkenyl group, and more preferably is a cycloalkyl group.

Cy has three to sixteen carbon atoms, preferably five to ten carbon atoms. The number of the carbon atoms means that the total number of the carbon atoms of Cy including the carbon atoms contained in the ring and the atoms contained in substituent groups. Cy may be substituted with an alkyl group (including a cycloalkyl group), an alkenyl group (including a cycloalkenyl group) or a halogen atom.

Examples of the alicyclic groups include cyclopropyl, cyclobutyl, cyclopentyl, cyclohexyl, cycloheptyl, cyclooctyl, cyclodecyl, cyclododecyl, 1-methylcyclohexyl, 2-methylcyclohexyl, 3-methylcyclohexyl, 4-methylcyclohexyl, 2-cyclohexylcyclohexyl, 4-cyclohexylcyclohexyl, 2-ethylcyclohexyl, 4-ethylcyclohexyl, 2-n-propylcyclohexyl, 4-t-butylcyclohexyl, 2,3-dimethylcyclohexyl, 3,5-dimethylcyclohexyl, 2-chlorocyclohexyl, 1-cyclohexenyl, 2-cyclohexenyl, 3-cylcohexyenyl and cyclododecenyl. Cyclopentyl, cyclo-hexyl, cycloheptyl, cyclooctyl, 2-methylcyclohexyl and 2-cyclohexenyl are preferred.

According to study of the applicants, an alkyl group of a long chain have a bulk chemical structure. Further, a bicyclic and tricyclic hydrocarbon group having a bridgehead carbon atom is also made of a bulk chemical structure. It is difficult to make a water-resistant surface backing layer by a polymer having such a bulk hydrocarbon group at the side chain. The bulk group forms a large free volume among the polymer. The free volume allows water molecules passing through the layer.

The above-mentioned specific alicyclic group of a monocyclic ring has a sufficient hydrophobic character without such a bulk structure. The effect of the present invention is obtained by the specific alicyclic group.

Examples of the repeating units represented by the formula (I) are shown below.

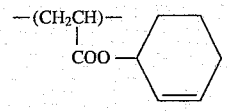

(I-1)

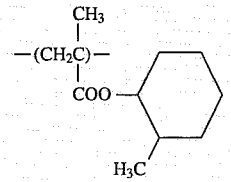

(I-2)

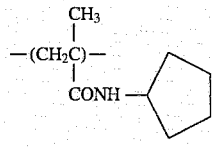

(I-3)

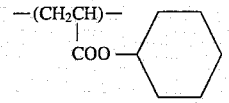

(I-4)

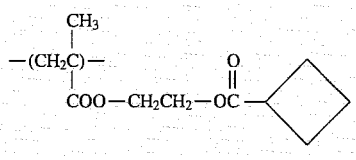

(I-5)

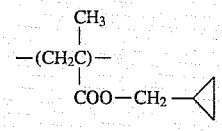

(I-6)

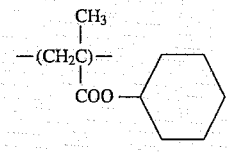

(I-7)

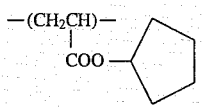

(I-8)

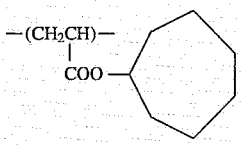

(I-9)

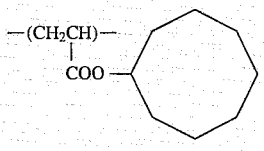

(I-10)

-continued
(I-11)
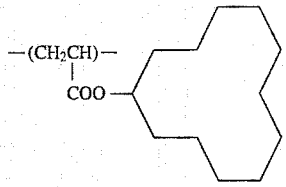
(I-12)
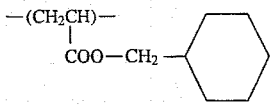
(I-13)
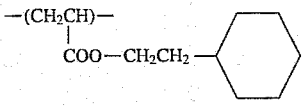
(I-14)
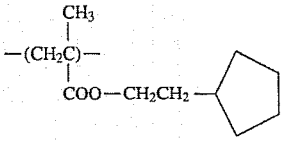
(I-15)
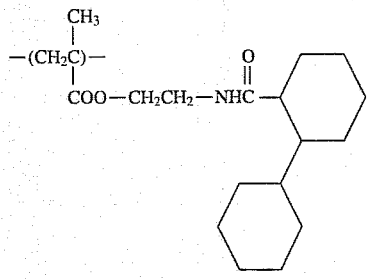
(I-16)
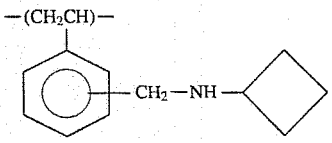
(I-17)
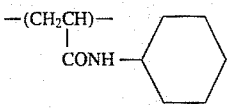
(I-18)
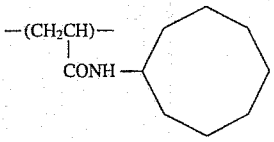
(I-19)
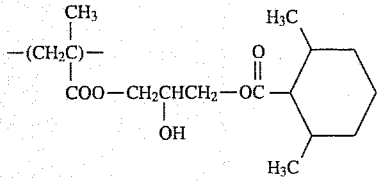
(I-20)
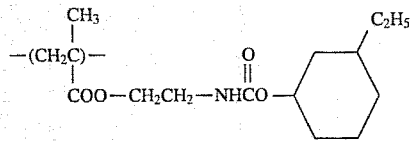
-continued
(I-21)
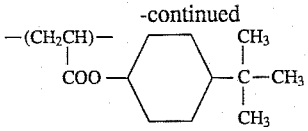
(I-22)
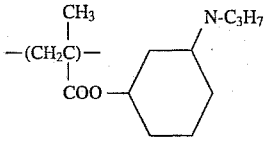
(I-23)
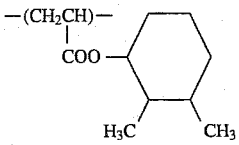
(I-24)
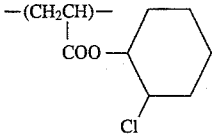
(I-25)
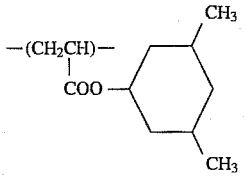
(I-26)
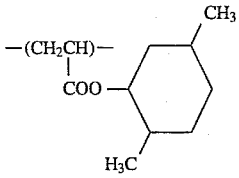
(I-27)
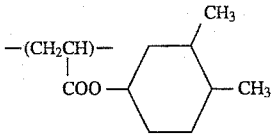
(I-28)
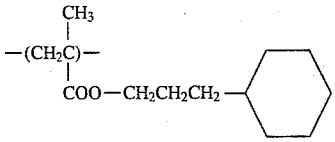
(I-29)
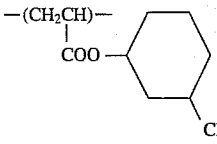
(I-30)
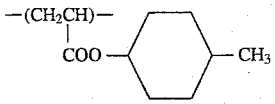
(I-31)
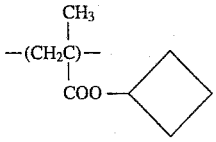

-continued

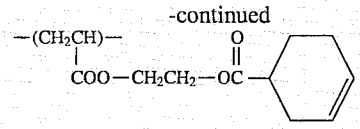
(I-32)

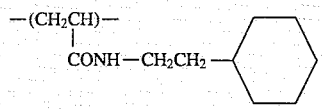
(I-33)

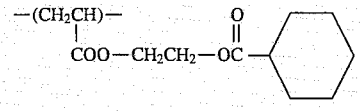
(I-34)

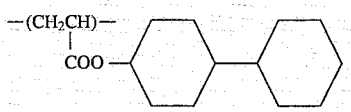
(I-35)

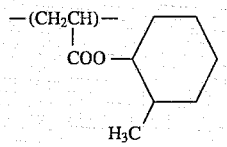
(I-36)

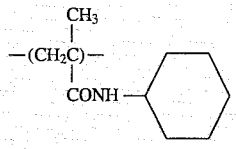
(I-37)

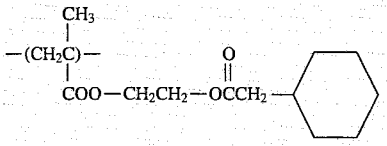
(I-38)

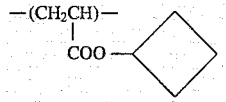
(I-39)

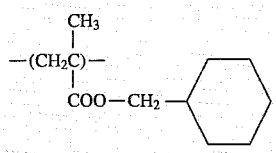
(I-40)

The hydrophobic polymer of the present invention can be in the form of a homopolymer consisting of a repeating unit represented by the formula (I). The polymer of the invention can also be in the form of a copolymer consisting of two or more repeating units represented by the formula (I). Further, the hydrophobic polymer can be in the form of a copolymer consisting of a repeating unit represented by the formula (I) and another repeating unit. In the copolymer, the amount of the repeating unit represented by the formula (I) is preferably not less than 50 wt. %. The term "wt. %" of the repeating unit means that the amount of a monomer which forms the repeating unit of the formula (I) is not less than 50 wt. %, based on the total amount of monomers which form the copolymer. The amount of the repeating unit of the formula (I) is more preferably not less than 75 wt. %.

An ethylenically unsaturated monomer is preferably used to form the copolymer. Examples of the monomers include acrylic esters or α-alkylacrylic (e.g., methacrylic) esters, acrylic amides or α-alkylacrylic amides, vinyl esters (e.g., vinyl acetate), acrylonitrile, methacrylonitrile, dienes (e.g., butadiene, isoprene), aromatic vinyl compounds (e.g., styrene, p-chlorostyrene, α-methylstyrene), vinylidene chloride, vinyl alkyl ethers (e.g., vinyl ethyl ether), ethylene, propylene, 1-butene and isobutene. Examples of the acrylic or α-alkylacrylic esters include methyl acrylate, ethyl acrylate, n-propyl acrylate, iso-propyl acrylate, n-butyl acrylate, iso-butyl methacrylate, sec-butyl methacrylate, benzyl acrylate, 2-ethylhexyl acrylate. Examples of the acrylic or α-alkylacrylic amides include n-butylacrylamide and t-butylacrylamide.

In the case that the copolymer is synthesized by a polymerization reaction in a suspension, an emulsion or a dispersion, the monomer preferably has at least two ethylenically unsaturated groups. Examples of the monomers having two or more ethylenically unsaturated groups include divinylbenzene, 4,4'-isopropylidenediphenylene diacrylate, 1,3-butylene diacrylate, 1,3-butylene dimethacrylate, 1,4-cyclohexylenedimethylene dimethacrylate, diethylene glycol dimethacrylate, diisopropylidene glycol dimethacrylate, divinyloxymethane, ethylene glycol diacrylate, ethylene glycol dimethacrylate, ethylidene diacrylate, ethylidene dimethacrylate, 1,6-diacrylamidohexane, N,N'-methylenebisacrylamide, 2,2-dimethyl-1,3-trimethylene dimethacrylate, phenylethylene dimethacrylate, tetraethylene glycol dimethacrylate, tetramethylene diacrylate, tetramethylene dimethacrylate, 2,2,2-trichloroethylidene dimethacrylate, triethylene glycol diacrylate, pentaerythritol triacrylate, trimethylolpropane triacrylate, tetramethylolmethane tetraacrylate, triethylene glycol dimethacrylate, 1,3,5-triacryloylhexanehydro-s-triazine, bisacrylamidoacetate, ethylidine trimethacrylate, propylidine triacrylate and vinylallyloxyacetate. Divinylbenzene and ethylene glycol dimethacrylate are particularly preferred.

The copolymer may consist of two or more monomers in addition to the repeating unit of the formula (I).

Examples of the copolymers are shown below. In the following formulas, the composition means wt. % of the monomers.

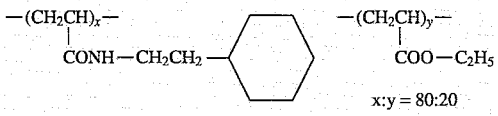
(CP-1)

x:y = 80:20

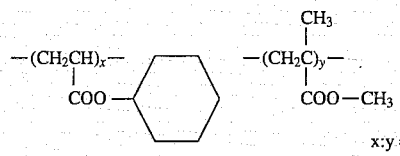
(CP-2)

x:y = 75:25

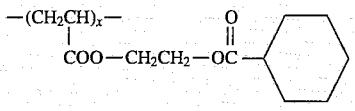
(CP-3)

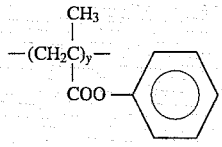

x:y = 90:10

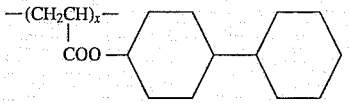
(CP-4)

x:y = 65:35

-continued (CP-5)

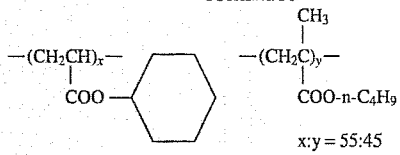

x:y = 55:45

(CP-6)

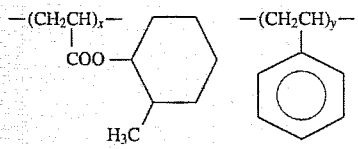

x:y = 75:25

(CP-7)

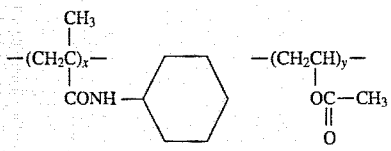

x:y = 80:20

(CP-8)

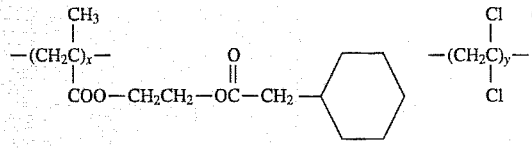

x:y = 65:35

(CP-9)

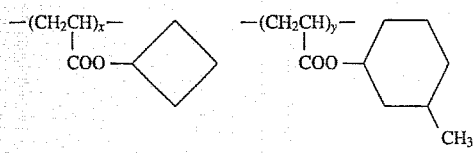

x:y = 50:50

(CP-10)

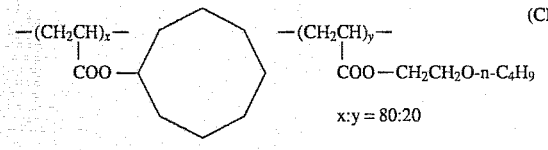

x:y = 80:20

(CP-11)

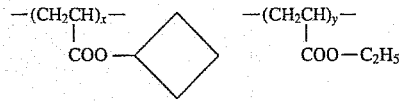

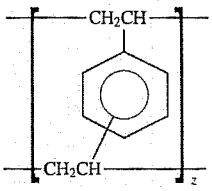

x:y:z = 60:30:10

(CP-12)

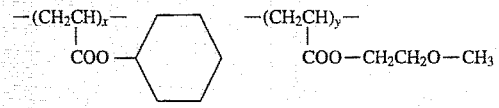

-continued

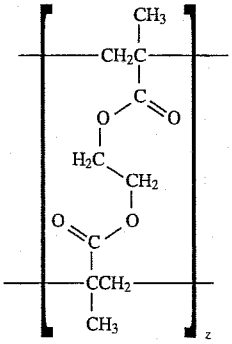

x:y:z = 80:15:5

(CP-13)

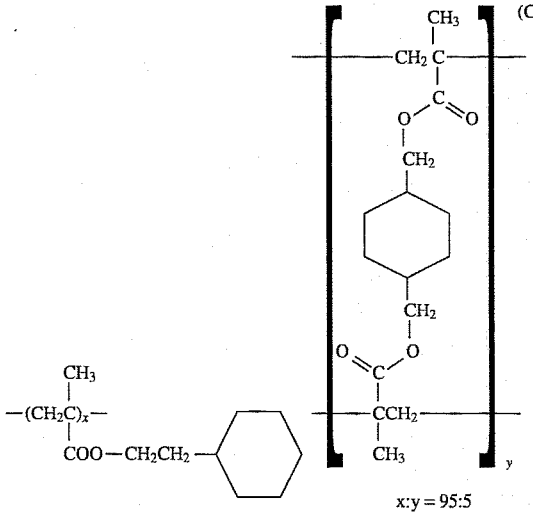

x:y = 95:5

The hydrophobic polymer preferably has a solubility in water of less than 5 wt. % (more preferably less than 3 wt. %) at 25° C. The hydrophobic polymer preferably has an average molecular weight in the range of 5,000 to 1,000,000, and more preferably in the range of 10,000 to 700,000. Two or more hydrophobic polymers can be used in combination.

The hydrophobic polymer can be synthesized by a radical polymerization reaction. The radical polymerization reaction is described in Takayuki Ootsu et al., Experimental Method of Polymer Synthesis I (Tokyo Kagaku Dojin, written in Japanese) and Takayuki Ootsu, Seminar of Theory of Polymerization Reaction 1, Radical Polymerization I (Tokyo Kagaku Dojin, written in Japanese). The reaction can proceed in a solution, a suspension, an emulsion, a dispersion or a precipitation. The emulsion polymerization is described in Soichi Muroi, Chemistry of Polymer Latex (Kobunshi Kanko-kai, written in Japanese). The dispersion polymerization is described in Barret, Keih E. J., Dispersion Polymerization in Organic Media (John Wiley & Sons).

In the case that the polymer is synthesized by an emulsion polymerization reaction, a surface active agent is preferably used. An anionic surface active agent is more preferably used. Examples of the anionic surface active agents are shown below.

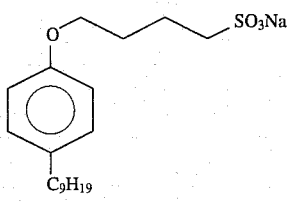

(S-1)

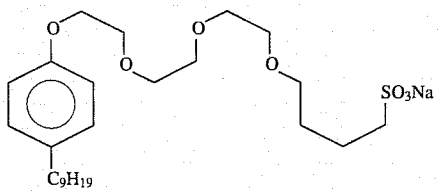

(S-2)

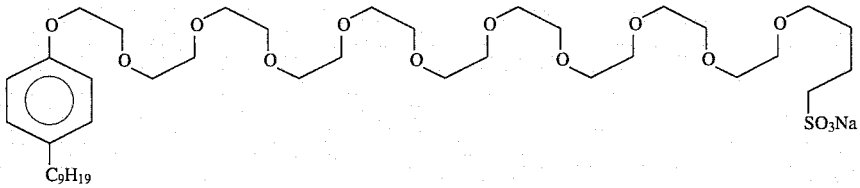

(S-3)

$C_{12}H_{25}-OSO_3Na$ (S-4)
$C_{10}H_{21}-OSO_3Na$ (S-5)
$C_{14}H_{29}-OSO_3Na$ (S-6)

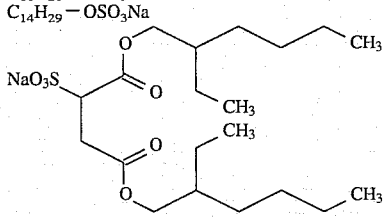

(S-7)

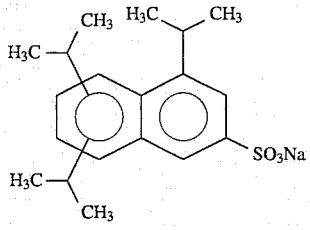

(S-8)

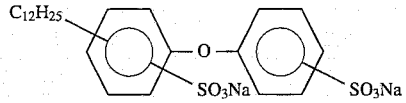

(S-9)

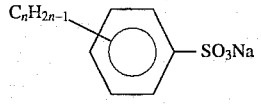

(n = 10 to 16)

(S-10)

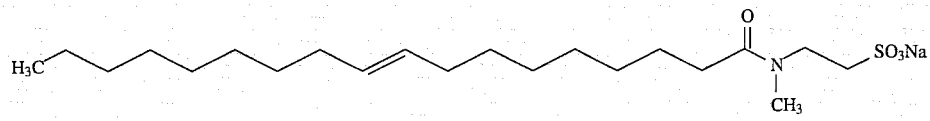

(S-11)

The synthesis examples of the hydrophobic polymers are shown below. The other polymer solutions can be synthesized in a similar manner to the synthesis examples 1 and 3. The other polymer latex can also be synthesized in a similar manner to the synthesis example 2.

SYNTHESIS EXAMPLE 1

Synthesis of polycyclohexyl acrylate (homopolymer of I-4) in a solution

In a glass three neck flask of 300 ml having a disperser, a thermometer and a reflux tube, 156 ml of ethyl acetate and 50 g of cyclohexyl acrylate were placed. The mixture was stirred at 70° C. in a stream of nitrogen. To the mixture, 0.2 g of dimethyl-2,2'-azobisisobutyrate dissolved in 5 ml of ethyl acetate was added three times at the interval of 1 hour. The mixture was further stirred at 70° C. for 4 hours.

The reaction mixture was cooled to the room temperature, precipitated in 5 liter of methanol, and purified to obtain 45 g of polycyclohexyl acrylate. The average molecular weight was 192,000. The yield was 90%.

SYNTHESIS EXAMPLE 2

Synthesis of polycyclohexyl acrylate (homopolymer of I-4) in an emulsion

In a glass three neck flask of 300 ml having a disperser, a thermometer and a reflux tube, 0.5 g of the surface active agent (S-2) and 160 g of distilled water were placed. The mixture was stirred at 70° C. in a stream of nitrogen. To the mixture, 0.16 g of potassium persulfate dissolved in 10 ml of distilled water was added. Immediately after the addition, 50 g of cyclohexyl acrylate was dropwise added to the mixture for 2 hours using a constant speed dropping apparatus. Immediately after the addition, 0.16 g of potassium persulfate dissolved in 20 ml of distilled water was added to the mixture. The mixture was stirred at 70° C. for 3 hours.

The reaction mixture was cooled to the room temperature, and filtered off to obtain 238 g of latex. The solid content was 18.0 wt. %. The pH was 2.8. The average particle size was 62 nm. The yield was 90%.

SYNTHESIS EXAMPLE 3

Synthesis of cyclooctylacrylamide

In a glass three neck flask of 300 ml having a disperser, a thermometer and a reflux tube, 21 g of acrylonitrile (0.39 mol) and 50 g of cyclooctanol were placed. The mixture was stirred at 70° C. To the mixture, 42 ml of sulfuric acid was dropwise added for 2 hours. The mixture was stirred at 70° C. for 4 hours.

The reaction mixture was cooled to the room temperature, crystallized in 700 g of ice-cold water, and dried to obtain 62.8 g of cyclooctylacrylamide monomer in the form of white crystals. The yield was 88.4%.

Synthesis of polycyclooctylacrylamide (homopolymer of I-10) in a solution

In a glass three neck flask of 300 ml having a disperser, a thermometer and a reflux tube, 120 ml of 1-methoxy-2-propanol and 40 g of cyclooctylacrylamide were placed. The mixture was stirred at 70° C. in a stream of nitrogen. To the mixture, 0.2 g of dimethyl-2,2'-azobisisobutyrate dissolved in 5 ml of 1-methoxy-2-propanol was added. The mixture was further stirred at 70° C. for 2 hours. To the mixture, 0.2 g of dimethyl-2,2'-azobisisobutyrate dissolved in 5 ml of 1-methoxy-2-propanol was further added. The mixture was further stirred at 70° C. for 4 hours.

The reaction mixture was cooled to the room temperature, precipitated in 5 liter of distilled water, and purified to obtain 36 g of polycyclooctylacrylamide. The average molecular weight was 15,000. The yield was 90%.

The surface backing layer of the present invention is substantially water-resistant because of the function of the hydrophilic polymer. The substantial water-resistance means that the layer swells 1.3 time or less in the thickness after the layer is immersed in water at 38° C. for 1 minute. The swelling ratio is preferably not more than 1.1 times.

In the case that the surface backing layer is directly provided on the anticurl backing layer, the lamination of the layers swells preferably 1.5 times or less, and more preferably 1.45 times or less in the thickness after the lamination is immersed in water at 38° C. for 1 minute. Further, the increase in the thickness after the immersion is preferably not more than 2 μm, and more preferably not more than 1 μm.

The surface backing layer of the invention may further contain photographic additives such as a matting agent, a surface active agent, a dye, a slipping agent, a crosslinking agent, an adhesive agent, a UV absorbent, inorganic particles such as colloidal silica. The photographic additives are described in Research Disclosure, volume 176, item 17643, (December 1978).

The surface backing layer may consist of two or more layers.

The thickness of the surface backing layer is determined by the function of the layer and the characteristics of the hydrophilic polymer. A very thin layer has a poor function of shielding an anticurl backing layer from processing solutions. On the other hand, a very thick layer inhibits evaporation of water from the anticurl layer to curl the photographic material. The surface backing layer has a thickness preferably in the range of 0.05 to 10 μm, and more preferably in the range of 0.1 to 5 μm. In the case that the surface backing layer consists of two or more layers, the above-mentioned thickness means the total thickness of the layers.

The surface backing layer is provided as the lowermost layer of the photographic material. The layer can be formed according to a conventional coating method. For examples, a coating solution is coated on the other backing layers and dried to form the surface backing layer. The surface backing layer can also be formed simultaneously with the formation of the other backing layers according to a simultaneous coating method.

In the silver halide photographic material of the present invention, an anticurl backing layer is provided between a support and the above-mentioned surface backing layer. The anticurl backing layer usually contain a hydrophilic polymer (hydrophilic colloid) as a binder. The hydrophilic polymer preferably has a hygroscopic property analogous to that of the binders of the silver halide emulsion layers. The preferred hydrophilic polymer is gelatin. Examples of the gelatins include a lime-treated gelatin, an acid-treated gelatin, an enzyme-treated gelatin, a gelatin derivative and a denatured gelatin, which have been conventionally used in photography. The lime-treated gelatin and acid-treated gelatin are preferred. The other hydrophilic colloids are also available as the binder of the anticurl backing layer. Examples of the hydrophilic colloids include proteins, saccharides and synthetic hydrophilic polymers. Examples of the proteins include colloidal albumin and casein. Examples of the saccharides include agar, sodium alginate, starch derivatives and cellulose compounds (e.g., carboxymethyl cellulose, hydroxymethyl cellulose). Examples of the synthetic hydrophilic polymers include polyvinyl alcohol, poly-N-vinylpyrrolidone and polyacrylamide. The synthetic hydrophilic polymer can be used in the form of a copolymer. If an excess amount of hydrophilic repeating unit is used in the copolymer, the hygroscopic amount and rate of the anticurl layer is decreased to degrade the anticurl function. Two or more hydrophilic polymers can be used in combination.

The anticurl backing layer may further contain photographic additives such as a matting agent, a surface active agent, a dye, a cross-linking agent, an adhesive agent, a UV absorbent, inorganic particles such as colloidal silica. The photographic additives are described in Research Disclosure, volume 176, item 17643, (December 1978).

The anticurl backing layer may furthermore contain a polymer latex. The polymer latex contains particles of a water-insoluble polymer dispersed in water. The average size of the particles is preferably in the range of 20 to 200 nm. The dry weight ratio of the polymer latex to the hydrophilic polymer is preferably in the range of 0.01 to 1.0, and more preferably in the range of 0.1 to 0.8. Examples of the monomer units of the polymer latex include alkyl acrylates, hydroxyalkyl acrylates, glycidyl acrylates, alkyl methacrylates, hydroxyalkyl methacrylates and glycidyl methacrylates. The polymer in the latex preferably has an average molecular weight of not less than 100,000, and more preferably in the range of 300,000 to 500,000. Examples of the preferred latex polymers are shown below.

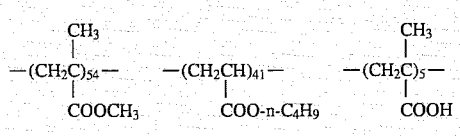

(LP-1)

(Average particle size: 0.12 μm)

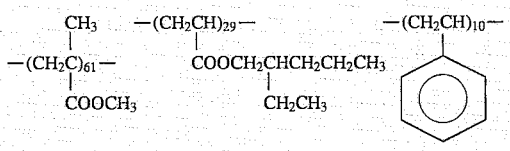

(LP-2)

(Average particle size: 0.20 μm)

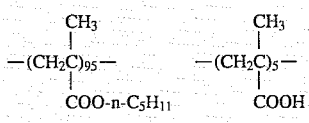

(LP-3)

(Average particle size: 0.08 μm)

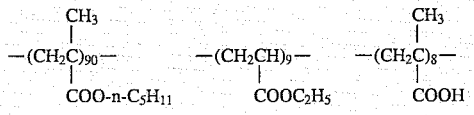

(LP-4)

(Average particle size: 0.05 μm)

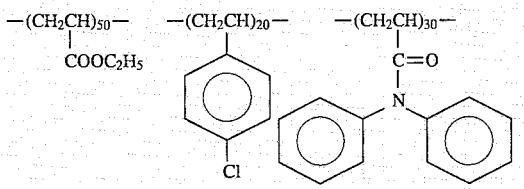

(LP-5)

(Average particle size: 0.18 μm)

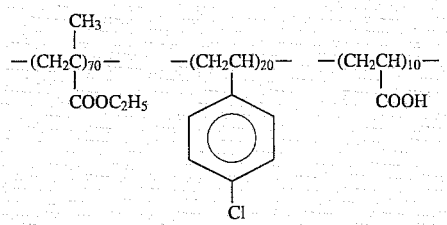

(LP-6)

((Average particle size: 0.05 μm)

-continued

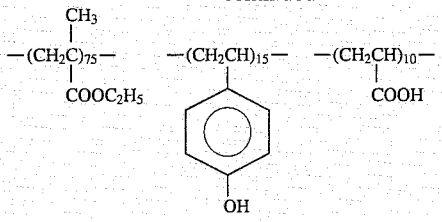

(LP-7)

((Average particle size: 0.03 μm)

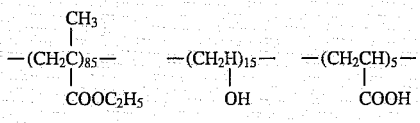

(LP-8)

((Average particle size: 0.10 μm)

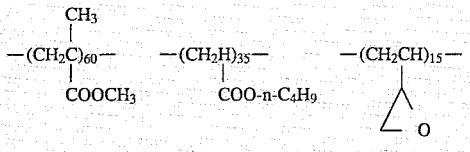

(LP-9)

((Average particle size: 0.10 μm)

The anticurl backing layer may consist of two or more layers. The thickness of the anticurl backing layer is preferably similar to the thickness of the silver halide emulsion layers. The thickness is generally in the range of 0.2 to 20 μm, and preferably in the range of 0.5 to 10 μm. In the case that the anticurl backing layer consists of two or more layers, the above-mentioned thickness means the total thickness of the layers.

The anticurl backing layer is substantially water-resistant because of the function of the surface backing layer. The substantial water-resistance means that the anticurl backing layer swells 2 times or less in the thickness after the layer is immersed in water at 38° C. for 1 minute. The swelling ratio is preferably not more than 1.5 times.

The anticurl backing layer can be coated on a support according to conventional processes, such as a dip coating method, an air knife coating method, a curtain coating method, a roller coating method, a wire bar coating method, a gravure coating method, an extrusion coating method and a simultaneous multi-layered coating method. The extrusion method using a hopper is described in U.S. Pat. No. 2,681,294. The simultaneous coating method is described in U.S. Pat. Nos. 2,761,418, 3,508,947 and 2,761,791.

The other backing layers may be provided on the photographic material. The other layers include an undercoating backing layer, an anitistatic backing layer, a matting backing layer and an antihalation backing layer.

The support of the photographic material is described below. Various plastic films are available as the support. Examples of the plastics include cellulose derivatives (e.g., diacetyl cellulose, triacetyl cellulose, propionyl cellulose, butanoyl cellulose, acetyl propionyl cellulose acetate), polyamides, polycarbonates, polyesters (e.g., polyethylene terephthalate, poly-1,4-cyclohexanedimethylene terephthalate, polyethylene 1,2-diphenoxyethane-4,4'-dicarboxylate, polybutylene terephthalate, polyethylene naphthalate), polystyrenes, polypropylenes, polyethylenes, polymethylpentenes, polysulfones, polyethersulfones, polyallylates and polyetherimides.

The support has a thickness preferably in the range of 20 μm to 1 mm, more preferably in the range of 50 to 300 μm, and most preferably in the range of 60 to 200 μm.

There is no specific limitation with respect to silver halide emulsion layers provided on the support.

The shape of silver halide grains may be either in the form of a regular crystal such as cube and octahedron or in the form of an irregular crystal such as globular shape and tabular shape. A grain having a defect of crystalline such as twined crystal is also available. The shape of the grain may be complex of these crystals.

The grain size of the silver halide is usually in the range of 0.2 to 10 μm. With respect to the grain size distribution, a monodispersed emulsion and a polydispersed emulsion are available.

A silver halide emulsion is usually subjected to a physical ripening, a chemical sensitization and a spectral sensitization. The chemical sensitization is preferably conducted by using a gold sensitizer and a sulfur sensitizer. The additives for the physical ripening, the chemical sensitization and the spectral sensitization are described in Research Disclosure Nos. 17643 and 18716.

The other additives for photographic materials are also described in Research Disclosure Nos. 17643 and 18716, as follows.

| Additives | No. 17643 | No. 17643 |
|---|---|---|
| Chemical sensitizers | Page 23 | Page 648, right column |
| Sensitivity increasing agent | | Page 648, right column |
| Spectral sensitizing dye and Supersensitizer | Pages 23 to 24 | Page 648, right column to page 649, right column |
| Breaching agent | Page 24 | |
| Antifogging agent and stabilizer | Page 24 to 25 | Page 649, right column |
| Light absorbing agent, filter dye and ultraviolet absorbent | Pages 25 to 26 | Page 650, right column |
| Stain inhibitor | Page 25, right column | Page 650 |
| Color image stabilizer | Page 25 | |
| Hardening agent | Page 26 | Page 651, right column |
| Binder | Page 26 | Page 651, right column |
| Plasticizer and slip agent | Page 27 | Page 650, right column |
| Coating aid and surface active agent | Pages 26 to 27 | Page 650, right column |

The silver halide photographic material can contain various couplers. The couplers are described in Research Disclosure No. 17643, VII-C to G. The couplers can be introduced into the photographic material according to various known dispersing methods.

The silver halide photographic material of the present invention can be developed according to a conventional method, which described in Research Disclosure Nos. 17643, pages 28 to 29 and 18716, page 615. The present invention is particularly effective in the case that the photographic material is subjected to a rapid development process, a rapid fixing process, a rapid washing process and a rapid drying process. The rapid processes mean that the total time for the processes is in the range of 15 to 60 seconds. The line speed in an authomatic developing machine is preferably not less than 1,000 mm per minute.

EXAMPLE 1

Formation of anticurl backing layer.

On the both surface of a polyethylene terephthalate support, undercoating layers were formed. On the back surface of the support, the following solution was coated according to a slide coating method.

| Anticurl backing layer | |
|---|---|
| Gelatin (isoelectric point: 4.8) | 2.5 g/m$^2$ |
| Sodium dodecylbenzensulfonate | 10 mg/m$^2$ |
| Sodium polystyrenesulfonate | 30 mg/m$^2$ |
| N,N'-ethylenebis(vinylsulfonacetamide) | 25 mg/m$^2$ |
| pH (adjusted with 1N hydrochloric acid) | 5.7 |

Formation of surface backing layer

After the anticurl backing layer was coated, the support was left at 25° C. and at the relative humidity of 65% for one week to harden gelatin by a cross-linking reaction. The following solution was coated on the anticurl backing layer using a wire bar, and dried at 35° C. and at the relative humidity of 30%. The concentration of the polymer in the coating solution was adjusted to 18 wt. %.

| Surface backing layer | |
|---|---|
| Polymer latex or polymer solution (set forth in Table 1) | 2.0 g/m$^2$ |
| Sodium dodecylbenzenesulfonate | 16.5 mg/m$^2$ |
| Polymethyl methacrylate particles (average particle size: 3 μm) | 10 mg/m$^2$ |
| $C_8F_{17}SO_3K$ | 5 mg/m$^2$ |

Evaluation of samples

The obtained samples were stored at 25° C. and at the relative humidity of 60% for one week. The samples were then evaluated in the following manners.

(1) Swelling ratio of the backing layers

The swelling ratio was measured using an electron micrometer (Anritsu Electric Co., Ltd.). The measuring force before swelling was 30±5 g, and the force after swelling was 2±0.5 g. The measurement was conducted at 25° C. and at 38° C.

(3) Recovery from curl

The samples were cut into pieces of 5 cm length and 1 cm width. The pieces were stored at 25° C. and at the relative humidity of 60% for 3 days. Then, they were further stored at 25° C. and at the relative humidity of 10%. The curled value was measured. The curled value and the recovery from curl were determined according to the following formulas.

Curled value=1/{radius of curvature of the sample (cm)}

Recovery of curl={(curled value after 20 seconds)/(curled value after 2 hours)}×100(%)

The recovery of curl is preferably not less than 60% for practical use.

The results are set forth in Table 1. It is apparent from the results shown in Table 1, the polymer solution or latex of the present invention effectively reduces swelling of the layers, particularly 38° C., which is the temperature of the processing solutions. The present invention is also effective in recovery from curl.

TABLE 1

| Polymer in surface backing | | | Swelled thickness | | Recovery |
|---|---|---|---|---|---|
| Unit | Form | MW | 25° C. | 38° C. | of curl |
| I-2 | Solution | 54,000 | 0.2 μm | 0.4 μm | 71 |
| I-4 | Solution | 192,000 | 0.2 μm | 0.4 μm | 73 |

TABLE 1-continued

| Polymer in surface backing | | | Swelled thickness | | Recovery |
|---|---|---|---|---|---|
| Unit | Form | MW | 25° C. | 38° C. | of curl |
| I-7 | Solution | 79,000 | 0.3 μm | 0.7 μm | 81 |
| I-8 | Emulsion | 333,000 | 0.5 μm | 0.8 μm | 98 |
| I-11 | Solution | 14,000 | 0.2 μm | 0.5 μm | 67 |
| I-15 | Solution | 32,000 | 0.4 μm | 0.7 μm | 75 |
| I-17 | Solution | 11,000 | 0.5 μm | 1.0 μm | 80 |
| I-18 | Solution | 11,500 | 0.3 μm | 0.7 μm | 63 |
| I-21 | Emulsion | 380,000 | 0.5 μm | 0.9 μm | 95 |
| I-23 | Emulsion | 430,000 | 0.4 μm | 0.7 μm | 88 |
| I-26 | Solution | 42,000 | 0.2 μm | 0.4 μm | 63 |
| I-30 | Solution | 175,000 | 0.3 μm | 0.6 μm | 76 |
| CP-5 | Emulsion | 289,000 | 0.5 μm | 1.0 μm | 100 |
| CP-7 | Solution | 37,000 | 0.6 μm | 0.9 μm | 85 |
| X-1 | Solution | 220,000 | 3.2 μm | 3.5 μm | 95 |
| X-2 | Emulsion | 558,000 | 3.0 μm | 3.5 μm | 100 |
| X-3 | Emulsion | 460,000 | 0.8 μm | 2.0 μm | 88 |
| X-4 | Solution | 136,000 | 0.6 μm | 1.6 μm | 80 |
| X-5 | Solution | 37,000 | 2.6 μm | 2.7 μm | 67 |
| X-6 | Solution | 235,000 | 2.6 μm | 3.4 μm | 72 |
| X-7 | Solution | 22,500 | 2.3 μm | 3.2 μm | 76 |

(Remark)
Form: Polymerization in synthesis of the polymer in the form of a solution or an emulsion. The emulsions were prepared in a similar manner to the synthesis example 2.
MW: Weight average molecular weight measured by GPC (standard sample: polystyrene)

The comparative polymers X-1 to X-7 are shown below.

(X-1)

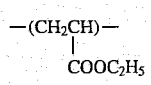

(X-2)

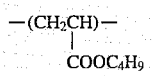

(X-3)

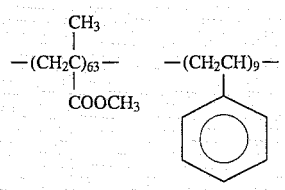

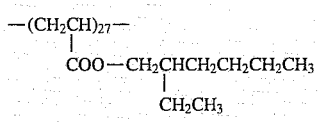

(X-4)

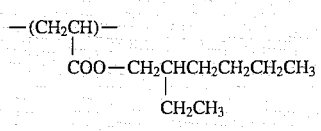

-continued (X-5)

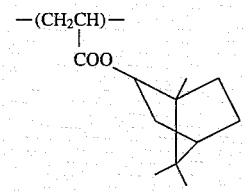

(X-6)

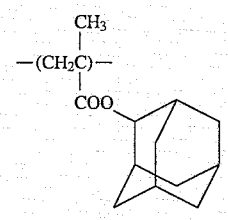

(X-7)

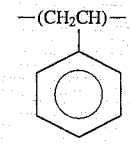

EXAMPLE 2

Formation of backing layers

On the both surface of a polyethylene terephthalate support (thickness: 100 μm), gelatin undercoating layers were formed. On the back surface of the support, the following solutions for the anticurl backing layer and the surface backing layer were simultaneously coated according to a slide coating method. In the coating method, the distance between the injector and the support is 0.25 mm, and the conveying speed of the support was 15 m per minute. The solution of the anticurl backing layer was coated at 35 ° C. The viscosity of the solution at the shearing speed of liter per second was 50 to 6 mPa•s.

| | |
|---|---|
| Anticurl backing layer | |
| Gelatin (isoelectric point: 5.7) | 2.5 g/m$^2$ |
| Sodium dodecylbenzensulfonate | 10 mg/m$^2$ |
| Sodium polystyrenesulfonate | 30 mg/m$^2$ |
| N,N'-ethylenebis(vinylsulfonacetamide) | 25 mg/m$^2$ |
| pH (adjusted with 1N hydrochloric acid) | 5.7 |
| Surface backing layer | |
| Polymer latex (set forth in Table 2) | 2.0 g/m$^2$ |
| Sodium dodecylbenzenesulfonate | 16.5 mg/m$^2$ |
| Polymethyl methacrylate particles | 10 mg/m$^2$ |
| $C_8F_{17}SO_3K$ | 5 mg/m$^2$ |

Evaluation of samples

After coating the surface backing layer, the support was air-dried in a chilling zone at the dry-bulb temperature of 20° C. and at the wet-bulb temperature of 15° C. to cause gelation of the coated layers. The support was further air-dried at the dry-bulb temperature of 35° C. and at the wet-bulb temperature of 20° C.

The obtained samples were stored at 25° C. and at the relative humidity of 60% for one week. The samples were then evaluated in the following manners.

(1) Swelling ratio of the backing layers

The swelling ratio was measured using an electron micrometer (Anritsu Electric Co., Ltd.). The measuring force before swelling was 30±5 g, and the force after swelling was 2±0.5 g. The measurement was conducted at 38° C.

(2) Crack in the coated layers

Crack in the coated layers were observed. The crack was evaluated as the following three grades.

A: No crack was observed.

B: Short cracks (length: 2 mm or less) were observed.

C: Long cracks (length: more than 2 mm) were observed.

(3) Adhesion

The samples were cut into pieces of 5 cm length and 5 cm width. Two pieces were laminated facing the coated layers. The lamination was stored under the pressure of 100 kg/cm$^2$ for 16 hours. The adhesion was then evaluated as the following four grades.

A: Adhered area is 0 to 5%.

B: Adhered area is 5 to 30%.

C: Adhered area is 30 to 60%

D: Adhered area is 60 to 100%.

The results are set forth in Table 2. It is apparent from the results shown in Table 2, the polymer latex of the present invention effectively improves the water-resistance and prevents the adhesion and the crack even in the case that the anticurl backing layer and the surface backing layer are simultaneously coated. The latex was prepared in the same manner as in the synthesis example 2, except that the surface active agent (surfactant) was changed as is shown in Table 2.

TABLE 2

| Polymer latex | | Swelled | | |
|---|---|---|---|---|
| Unit | Surfactant | thickness | Crack | Adhesion |
| I-1 | S-4 | 0.6 μm | A | B |
| I-2 | S-8 | 0.7 μm | A | A |
| I-4 | S-2 | 0.8 μm | A | A |
| I-6 | S-4 | 0.9 μm | A | B |
| I-7 | S-7 | 0.6 μm | A | A |
| I-9 | S-6 | 0.5 μm | A | B |
| I-12 | S-11 | 1.0 μm | A | A |
| I-13 | S-10 | 1.0 μm | A | A |
| I-16 | S-4 | 0.9 μm | A | B |
| I-20 | S-2 | 1.0 μm | A | A |
| I-24 | S-7 | 0.8 μm | A | A |
| I-27 | S-9 | 0.6 μm | A | A |
| CP-9 | S-7 | 0.6 μm | A | B |
| CP-12 | S-9 | 0.7 μm | A | A |
| X-2 | S-4 | 4.1 μm | A | D |
| X-3 | S-11 | 3.2 μm | B | B |
| X-8 | S-8 | 2.7 μm | C | B |

The comparative polymers X-1 and X-3 are shown in Example 1. The comparative polymer X-8 is shown below.

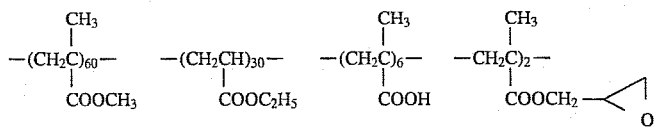

(X-8)

EXAMPLE 3

Formation of first undercoating layer

On the both surface of a biaxially stretched polyethylene terephthalate support (thickness: 100 μm), the following solution was coated and dried at 180° C. for 2 minutes to form first undercoating layers having the dry thickness of 0.9 μ.

| First undercoating layer | |
|---|---|
| Aqueous dispersion of vinylidene chloride/methyl methacrylate/ acrylonitrile/methacrylic acid copolymer (weight ratio: 90/8/1/1) | 15 weight parts |
| 2,4-Dichloro-6-hydroxy-s-triazine | 0.25 weight part |
| Polystyrene particles (average particle size: 3 μm) | 0.05 weight part |
| The following compound 1 | 0.20 weight part |
| Water to make up to | 100 weight parts |
| pH (adjusted with 10 wt. % KOH) | 6 |

-continued

| First undercoating layer |
|---|

(Compound 1)

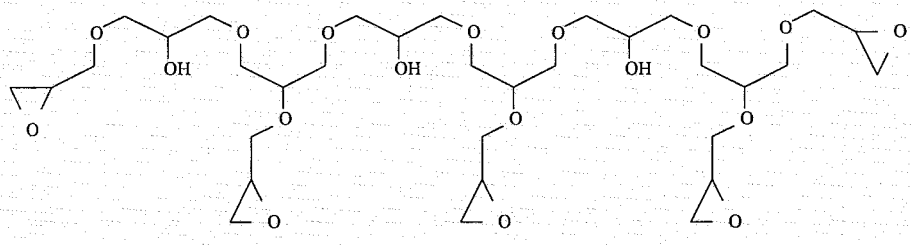

Formation of second undercoating layer

On the both surface of the first undercoating layers, the following solution was coated and dried at 170° C. for 2 minutes to form second undercoating layers having the dry thickness of 0.1 μm.

| Second undercoating layer | |
|---|---|
| Gelatin | 1 weight part |
| Methyl cellulose | 0.05 weight part |
| The following compound 2 | 0.02 weight part |
| $C_{12}H_{25}O(CH_2CH_2O)_{10}H$ | 0.03 weight part |
| The following compound 3 | $3.5 \times 10^{-3}$ weight part |
| Acetic acid | 0.2 weight part |
| Water to make up to | 100 weight parts |

(Compound 2)

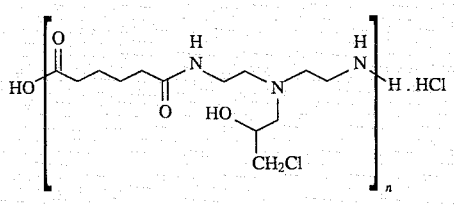

(Compound 3)

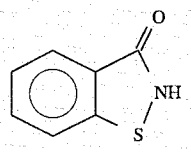

Formation of antistatic backing layer

On the back surface of the second undercoating layer, the following solution was coated to form an antistatic backing layer (surface resistance: $2\times10^{10}\Omega$ at 25° C. and at the relative humidity of 10%).

| Antistatic backing layer | |
|---|---|
| $SnO_2$/Sb (weight ratio: 9/1, average particle size: 0.25 μm) | 300 mg/m$^2$ |
| Gelatin ($Ca^{++}$ content: 30 ppm) | 170 mg/m$^2$ |
| The compound 3 | 7 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |

Formation of backing layers

On the antistatic backing layer, an anticurl backing layer and a surface backing layer were formed in the same manner as in Example 2. The details of the backing layers are set forth in Table 3.

Formation of emulsion layers

On the reverse surface of the support (on which the backing layers were not provided), a dye layer, an emulsion layer, a lower protective layer and an upper protective layer (shown in example 3 of Japanese Patent Provisional Publication No. 5(1993)-127282) were coated to prepare samples.

FIG. 1 is a sectional view schematically illustrating the layered structure of the prepared sample. As is shown in FIG. 1, first undercoating layers (2) are provided on a support (1). Second undercoating layers (3) are provided on the first undercoating layers (2). On the back surface of the second coating layer (3), an antistatic backing layer (4) is provided. Further, an anticurl backing layer (5) is provided on the antistatic backing layer (4). Furthermore, a surface backing layer (5) is provided on the anticurl backing layer. On the reverse surface of the second coating layer (3), a dye layer (7) is provided. Further, a silver halide emulsion layer (8) is provided on the dye layer (7). Furthermore, a lower protective layer (9) and an upper protective layer (10) are provided on the silver halide emulsion layer (8).

Evaluation of samples

The samples were stored at 25° C. and at the relative humidity of 60% for one week. The samples were then evaluated in the following manner.

(1) Swelling ratio of the backing layers

After the following washing process, the samples were freeze-dried in liquid nitrogen. The slice of the sample was observed by a scanning electron microscope to determine the thickness (d) of the anticurl backing layer or the surface backing layer.

Further, after the following drying process, the slice of the sample was observed by a scanning electron microscope to determine the thickness ($d_0$) of the anticurl backing layer or the surface backing layer.

(2) Swelling ratio of the emulsion layer and the protective layer

The swelling ratio was measured using an electron micrometer (Anritsu Electric Co., Ltd.). The measuring force before swelling was 30±5 g, and the force after swelling was 2±0.5 g. The measurement was conducted at 38° C.

(3) Recovery from curl

The samples were cut into pieces of 5 cm length and 1 cm width. The pieces were stored at 25° C. and at the relative humidity of 60% for 3 days. Then, they were further stored at 25° C. and at the relative humidity of 10%. The curled value was measured. The curled value was determined according to the following formula.

Curled value=1/{radius of curvature of the sample (cm)}

The plus value means that the material is curled toward the side of the emulsion layer. The minus value means that the material is curled toward the side of the backing layers. The practically tolerable curled value is in the range of −0.02 to +0.02.

(4) Drying rate

The samples of a large full size (51 cm×61 cm) were developed at 25° C. and at the relative humidity of 60° C. in an automatic developing machine (FG-710NH, Fuji Photo Film Co., Ltd.). The drying process in the machine was conducted at 50° C. while changing the line speed. The minimum time required for drying the sample completely was determined.

(5) Jamming

The rollers in the drying part of the above-mentioned automatic developing machine were replaced with smooth rollers made of a phenol resin. Then 12 pieces of the samples of 10×12 inch size were processed under the following conditions. Then the jamming of the samples was observed.

| Process | | |
|---|---|---|
| Development | 38° C. | 14.0 seconds |
| Fixing | 38° C. | 9.7 seconds |
| Washing | 25° C. | 9.0 seconds |
| Squeezing | | 2.4 seconds |
| Drying | 55° C. | 8.3 seconds |
| Total | | 43.4 seconds |
| Line speed | | 2,800 mm/minute |

The developing solution and the fixing solution were shown below. The amount of the replenisher was 200 ml per 1 $m^2$ of the film.

| Developing solution (processing temperature: 38° C.) | |
|---|---|
| Sodium 1,2-dihydroxybenzene-3,5-disulfonate | 0.5 g |
| Diethylenetriaminetetraacetic acid | 2.0 g |
| Sodium carbonate | 5.0 g |
| Boric acid | 10.0 g |
| Potassium sulfite | 85.5 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-hexahydro-2-thioxo-4-(1H)-quinazolidone | 0.05 g |
| Sodium 2-mercaptobenzimidazole-5-sulfonate | 0.3 g |
| Water | to make up to 1 liter |
| pH (adjusted with potassium hydroxide) | 10.7 |
| **Fixing solution (processing temperature: 38° C.)** | |
| Sodium thiosulfate | 160 g per liter |
| 1,4,5-Trimethyl-1,2,4-triazorium-3-thiorate | 0.25 mol per liter |
| Sodium bisulfite | 30 g per liter |
| Dihydric salt of disodium ethylenediaminetetraacetic acid | 0.25 mol per liter |
| pH (adjusted with sodium hydroxide) | 6.0 |

The results are set forth in Table 3. It is apparent from the results shown in Table 3 that the prevent invention improves the drying speed and the recovery from curl. Further, the samples of the invention do not cause the problems of jamming. The polymer was prepared in the same manner as in the synthesis example 2, except that the surface active agent (surfactant) was changed as is shown in Table 3. The surface backing layer was not provided on the last sample.

TABLE 3

| Polymer | | Anti- | (1) | | (2) | (3) | (4) | (5) |
|---|---|---|---|---|---|---|---|---|
| Unit | SF | curl | ACB | SB | Swell | Curl | Dry | Jam |
| I-1 | S-4 | + | 1.40 | 1.01 | 200 | 0.01 | 18 | − |
| I-4 | S-2 | + | 1.20 | 1.00 | 200 | 0.02 | 14 | − |
| I-6 | S-8 | + | 1.35 | 1.01 | 200 | 0.01 | 16 | − |
| I-9 | S-4 | + | 1.15 | 1.00 | 200 | 0.01 | 13 | − |
| I-12 | S-7 | + | 1.38 | 1.00 | 200 | 0.02 | 15 | − |
| I-13 | S-9 | + | 1.42 | 1.02 | 200 | 0.02 | 17 | − |
| I-27 | S-7 | + | 1.18 | 1.00 | 200 | 0.01 | 14 | − |
| CP-9 | S-2 | + | 1.25 | 1.00 | 200 | 0.02 | 16 | − |
| X-2 | S-4 | + | 2.10 | 1.00 | 200 | 0.01 | 37 | − |
| X-3 | S-11 | + | 1.70 | 1.00 | 200 | 0.01 | 31 | − |
| X-3 | S-1 | − | — | 1.00 | 200 | 0.09 | 13 | + |
| X-8 | S-8 | + | 1.10 | 1.00 | 200 | 0.01 | 14 | − |
| None | | − | — | — | 200 | 0.11 | 13 | + |

(Remark)
ACB: The ratio ($d/d_0$) of the anticurl backing layer
SB: The ratio ($d/d_0$) of the surface backing layer
Anticurl: The anticurl backing layer provided (+) or not provided (−)
Dry: Time required for drying the sample (second)
Jam: Jamming observed (+) or not observed (−)

We claim:

1. A silver halide photographic material comprising a silver halide emulsion layer and an anticurl backing layer provided on a support, wherein a surface backing layer is further provided on the anticurl backing layer, said surface backing layer comprising a hydrophobic polymer which is a homopolymer consisting of a repeating unit represented by the formula (I):

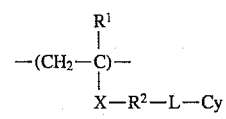

(I)

in which $R^1$ is a hydrogen atom or an alkyl group having one to four carbon atoms; X is —COO—, —CONR$^3$— or a phenylene group; $R^3$ is a hydrogen atom or an alkyl group having one to four carbon atoms; $R^2$ is a single bond or an alkylene group having one to three carbon atoms, which may be substituted with a hydroxyl group or a halogen atom; L is a single bond or a divalent linking group selected from the group consisting of —OCO—, —NHCOO—, —OCOCH$_2$—, —NHCONH—, —NHCO—, —NH— and —O—; and Cy is an alicyclic group consisting of a monocyclic ring and having three to sixteen carbon atoms, wherein the alicyclic group is unsubstituted or is substituted with an alkyl group, an alkenyl group or a halogen atom.

2. The silver halide photographic material as claimed in claim 1, wherein $R^1$ is hydrogen or methyl.

3. The silver halide photographic material as claimed in claim 1, wherein X is —COO— or —CONH—.

4. The silver halide photographic material as claimed in claim 1, wherein $R^2$ is the single bond, methylene, ethylene or 2-hydroxypropylene.

5. The silver halide photographic material as claimed in claim 1, wherein L is the single bond, —OCO— or —NH-COO—.

6. The silver halide photographic material as claimed in claim 1, wherein Cy is a cycloalkyl group consisting of a monocyclic ring.

7. The silver halide photographic material as claimed in claim 1, wherein Cy is an alicyclic group consisting of a monocyclic ring and having five to ten carbon atoms.

8. The silver halide photographic material as claimed in claim 1, wherein the hydrophobic polymer has a solubility in water of less than 5 wt. % at 25° C.

9. The silver halide photographic material as claimed in claim 1, wherein the hydrophobic polymer has an average molecular weight in the range of 5,000 to 1,000,000.

10. The silver halide photographic material as claimed in claim 1, wherein the surface backing layer has a thickness in the range of 0.05 to 10 μm.

11. A silver halide photographic material comprising a silver halide emulsion layer and an anticurl backing layer provided on a support, wherein a surface backing layer is further provided on the anticurl backing layer, said surface backing layer comprising a hydrophobic polymer which is a copolymer comprising a repeating unit represented by the formula (I) in an amount not less than 50 wt. %:

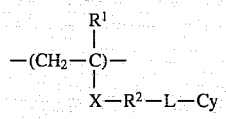

(I)

wherein $R^1$ is a hydrogen atom or an alkyl group having one to four carbon atoms; X is —COO—, —CONR$^3$— or a phenylene group; $R^3$ is a hydrogen atom or an alkyl group having one to four carbon atoms; $R^2$ is a single bond or an alkylene group having one to three carbon atoms, which may be substituted with a hydroxyl group or a halogen atom; L is a single bond or a divalent linking group selected from the group consisting of —OCO—, —NHCOO—, —OCOCH$_2$—, —NHCONH—, —NHCO—, —NH—, and —O—, and Cy is an alicyclic group consisting of a monocyclic ring and having three to sixteen carbon atoms, wherein the alicyclic group is unsubstituted or is substituted with an alkyl group, an alkenyl group or a halogen atom.

12. The silver halide photographic material as claimed in claim 11, wherein $R^1$ is a hydrogen atom or a methyl group.

13. The silver halide photographic material as claimed in claim 11, wherein X is —COO— or —CONH—.

14. The silver halide photographic material as claimed in claim 11, wherein $R^2$ is a single bond, a methylene group, an ethylene group or a 2-hydroxypropylene group.

15. The silver halide photographic material as claimed in claim 11, wherein L is a single bond, —OCO— or —NH-COO—.

16. The silver halide photographic material as claimed in claim 11, wherein Cy is a cycloalkyl group consisting of a monocyclic ring.

17. The silver halide photographic material as claimed in claim 11, wherein Cy is an alicyclic group consisting of a monocyclic ring and having five to ten carbon atoms.

18. The silver halide photographic material as claimed in claim 11, wherein the hydrophobic polymer has a solubility in water of less than 5 wt. % at 25° C.

19. The silver halide photographic material as claimed in claim 11, wherein the hydrophobic polymer has an average molecular weight in the range of 5,000 to 1,000,000.

20. The silver halide photographic material as claimed in claim 11, wherein the surface backing layer has a thickness in the range of 0.05 to 10 μm.

* * * * *